US008019819B2

(12) United States Patent
Monteverde et al.

(10) Patent No.: US 8,019,819 B2
(45) Date of Patent: Sep. 13, 2011

(54) METHODS AND SYSTEMS FOR EXPOSITIONS AND CONVENTIONS

(75) Inventors: Dante Monteverde, Barrington Hills, IL (US); Patrick Devereaux, Barrington Hills, IL (US)

(73) Assignee: Emergency 24, Inc., Chicago, IL (US)

( * ) Notice: Subject to any disclaimer, the term of this patent is extended or adjusted under 35 U.S.C. 154(b) by 95 days.

(21) Appl. No.: 12/141,880

(22) Filed: Jun. 18, 2008

(65) Prior Publication Data

US 2009/0319606 A1 Dec. 24, 2009

(51) Int. Cl.
*G06F 15/16* (2006.01)

(52) U.S. Cl. ..... 709/205

(58) Field of Classification Search ..... 709/204, 709/249, 205

See application file for complete search history.

(56) References Cited

U.S. PATENT DOCUMENTS

| | | | | |
|---|---|---|---|---|
| 5,796,351 | A | 8/1998 | Yabuki | |
| 5,936,542 | A * | 8/1999 | Kleinrock et al. | 340/5.61 |
| 6,434,530 | B1 | 8/2002 | Sloane et al. | |
| 6,557,007 | B1 | 4/2003 | Pekowski et al. | |
| 6,657,543 | B1 * | 12/2003 | Chung | 340/573.1 |
| 6,721,763 | B1 * | 4/2004 | Pekowski et al. | 707/104.1 |
| 7,010,530 | B2 * | 3/2006 | Bartkowiak et al. | 707/9 |
| 7,203,458 | B1 | 4/2007 | Cheng | |
| 7,590,688 | B2 * | 9/2009 | Franke | 709/204 |
| 7,702,720 | B1 * | 4/2010 | Franke | 709/203 |
| 2001/0014865 | A1 * | 8/2001 | Franke | 705/1 |
| 2001/0041994 | A1 | 11/2001 | Kim | |
| 2002/0013738 | A1 | 1/2002 | Vistisen | |
| 2002/0156848 | A1 | 10/2002 | Grouse | |
| 2002/0165731 | A1 | 11/2002 | Dempsey | |
| 2003/0156135 | A1 * | 8/2003 | Lucarelli | 345/757 |
| 2003/0195833 | A1 | 10/2003 | Baranowski | |
| 2005/0026631 | A1 | 2/2005 | Hull | |
| 2005/0071186 | A1 | 3/2005 | Manzo | |
| 2005/0119903 | A1 | 6/2005 | Lee | |
| 2005/0261932 | A1 | 11/2005 | Bottorff | |
| 2006/0168300 | A1 | 7/2006 | An et al. | |

(Continued)

FOREIGN PATENT DOCUMENTS

AU 7100441 6/2007

(Continued)

OTHER PUBLICATIONS

International Preliminary Report on Patentability dated Dec. 18, 2010; 8 pgs.

(Continued)

*Primary Examiner* — Krisna Lim
(74) *Attorney, Agent, or Firm* — Seyfarth Shaw LLP

(57) ABSTRACT

A convention center is disclosed having generally permanent booths 10 to avoid the need to provide installation for every convention thereat. The convention center is equipped for exhibitors to upload presentations prior to the show, the presentation being viewable remotely before, during, and after the convention by a number of parties, thus allowing exhibitors to make educated decisions on attending a convention and a cost therefor. Identification can be provided to visitors so that booths can identify a class for the visitor, and that class can be utilized to provide an appropriately selected presentation to the visitor. The identification can be used to track foot traffic in the convention hall, thus promoting more accurate pricing of booths. The identification can also be used as a navigation aid to the visitor.

34 Claims, 4 Drawing Sheets

U.S. PATENT DOCUMENTS

| | | | | |
|---|---|---|---|---|
| 2006/0188230 | A1 | 8/2006 | An | |
| 2007/0050131 | A1 | 3/2007 | Masuda | |
| 2007/0059674 | A1 | 3/2007 | Takano et al. | |
| 2007/0167135 | A1 | 7/2007 | Fontijn | |
| 2007/0228140 | A1 | 10/2007 | Kumagai et al. | |
| 2008/0055306 | A1* | 3/2008 | Kwok et al. | 345/419 |
| 2008/0091662 | A1* | 4/2008 | Franke | 707/3 |
| 2008/0120150 | A1* | 5/2008 | McSheffrey et al. | 705/7 |
| 2008/0195721 | A1* | 8/2008 | Chang et al. | 709/217 |
| 2008/0312946 | A1* | 12/2008 | Valentine et al. | 705/1 |

FOREIGN PATENT DOCUMENTS

| | | | |
|---|---|---|---|
| CN | 1770692 | A | 5/2006 |
| DE | 102004014001 | A1 | 2/2006 |
| GB | 2433856 | A | 7/2007 |
| JP | 10-300507 | A2 | 11/1998 |
| JP | 2001-285997 | A2 | 10/2001 |
| JP | 2005-011073 | A1 | 1/2005 |
| JP | 2005-011076 | A2 | 1/2005 |
| JP | 2005-025639 | A2 | 1/2005 |
| JP | 2005-063194 | A2 | 3/2005 |
| JP | 2005-242461 | A2 | 9/2005 |
| JP | 2005-257378 | A | 9/2005 |
| JP | 2006-110172 | A2 | 4/2006 |
| JP | 2006-127125 | A2 | 5/2006 |
| JP | 2006-243785 | A2 | 9/2006 |
| JP | 2006-258468 | A2 | 9/2006 |
| JP | 2007-079784 | A2 | 3/2007 |
| JP | 2007-152442 | A2 | 6/2007 |
| TW | 0254530 | B | 5/2006 |
| WO | WO2005/107389 | A2 | 11/2005 |
| WO | WO 2007/063571 | A2 | 7/2007 |

OTHER PUBLICATIONS

International Search Report dated Aug. 10, 2009; 8 pgs.

* cited by examiner

METHODS AND SYSTEMS FOR EXPOSITIONS AND CONVENTIONS

CROSS-REFERENCE TO RELATED APPLICATION(S)

The present application is related to co-pending application Ser. No. 12/141,883, filed Jun. 18, 2008, titled "User Positioning Guidance System, Devices, and Methods," the entirety of which is incorporated herein by reference.

FIELD OF THE INVENTION

The invention relates to expositions and conventions and, in particular, to methods, systems, and apparatus for constructing, hosting, and navigating expositions and conventions.

BACKGROUND

Virtually every town or city includes some type of physical setting used for the temporary hosting of gatherings, whether such gatherings are as simple as a town fair where people bring their wares and crafts for display or sale or barter, or whether such gatherings are as large as industry tradeshows having 2000 or more exhibitors covering 1.5 million square feet of convention floor space.

What generally stands out for these gatherings is the temporary nature of the displays and exhibits. In a typical convention center or the like, the basic structure is simply one or a series of large rooms, defined mostly by ceilings and perhaps the occasional support pillar and little else. For a typical convention or exposition, then, personnel representing each exhibitor arrives one or several days prior to the convention to oversee erection and assembly of a booth. Each exhibitor is assigned a floor area based on the size of booth for which the exhibitor has paid, and labor is employed for all assembly aspects.

In fact, in all states except Minnesota, all labor expended is the responsibility of local, highly-paid labor, regardless of an exhibitor's ability to perform the labor on its own. When an exhibitor arrives with a truck containing the exhibitor's booth materials such as electronic displays or wares, the major convention centers require local, highly-paid labor to unload the truck and deliver the materials to the booth site on the convention floor. Additional local, highly-paid labor is then used to install carpeting, electricals, lighting, etc., for the booth. This highly-paid labor is also utilized to build temporary structures for a particular booth, to provide an improved aesthetic for the convention as a whole, or to provide common areas, such as an information or directory booth and eating areas. All told, all labor at many convention sites is not local and highly-paid other than the exhibitor personnel, and the visitors or conventioneers. Other than pop-up displays, all labor within the booth is such local, highly-paid labor. For a number of reasons, it is difficult for a convention center to avoid the use of this local, highly-paid.

Staging of a booth by an exhibitor is expensive. As described, the use of local, highly-paid labor is expensive. Additionally, the electricals and lighting and carpeting and plumbing, for instance, are each installed for each booth at every show, and the labor is effectively discarded when the show is taken down, as are most materials; stock carpeting is sent for cleaning, and custom carpeting (such as that bearing an exhibitor's logo) is discarded. The booth materials that are brought by an exhibitor are expensive, in the order of $15,000 to $20,000. If an exhibitor attends two shows simultaneously, the booth materials costs to the exhibitor are doubled. Additionally, transportation of the booth materials and the time for exhibitor personnel are costs to the exhibitor. It is noted that, for a typical convention hosted by McCormick Center, owned and operated by the City of Chicago, Ill., set-up for the convention begins three days prior to the show's opening, the set-up being performed by the local labor.

An alternative to convention centers utilizing temporary booths is an industry or merchandise mart. Not nearly as common as convention centers, merchandise marts are similar to shopping malls in that a space is leased as a permanent display, built to specification for a tenant. While having the advantage of permanent walls, electricals, lighting, and flooring, the spaces at marts and malls are much more expensive, require a long-term commitment for a tenant, and are static in their display. As should be clear, such permanent displays do not lend themselves to the short-term usage desired by convention exhibitors, do not allow for rapid set-up, and require a full and permanent display in every location in which the tenant desires exposure.

Visitors or conventioneers, whether they be exhibitor personnel or simply industry personnel visiting the exhibitors' booths, are in a variety of classes or groups, depending on function. As examples, in relationship to a single exhibitor, visitors to the exhibitor's booth may be potential buyers of the exhibitor's goods or services, may be potential vendors, may be speakers or industry reporters, may be potential employees or partners, and may be competitors (exhibitors or not) looking to gain a grasp of other industry players.

Typically, visitors are given identification while in attendance that demonstrates their authorization to enter and be present at the convention, and this identification may present an indicia of their function, such as buyer or exhibitor personnel. One manner for providing the function indicia is to color code name tags so that exhibitor personnel stationed at a booth can recognize a visitor approaching or present in the booth as a potential buyer, for instance. The exhibitor personnel can then tailor a personal interaction with the visitor towards what the potential relationship warrants. However, the exhibitor personnel do not commonly have the ability to tailor the actual booth exhibit to the visitor, nor do the booth and exhibit support such tailoring.

From the visitor's perspective, navigating an exhibition hall can be somewhat daunting and result in wasted personal time and energy. As noted above, some exhibitions are hundreds of thousands, if not over a million, square feet of exhibition space. The exhibition space is organized into rows or aisle defined by the booths installed for the exhibition. As it should be clear, the result is aisle lengths that, when summed, add up to distances measured in miles. With conventions hosting 2000 or more exhibitors, it can be difficult to find the precise exhibitors that a particular visitor would like to, or has been sent to, visit, particular if the visitor desires not to waste a significant amount of time searching the convention hall or not to constantly backtrack between areas.

There are two basic manners known to somewhat alleviate the problems associated with a particular visitor's navigation of a convention hall. The most basic of the manners is a simple map of the exhibition floor provided beforehand or concurrent with entering the convention center. Of course, not everyone is adept at reading a map, and it can be labor-intensive for a visitor to first review a roster or exhibitors, select and target exhibitors to be visited, rank the exhibitors in terms of importance, compare the selected and ranked exhibitors to a map, and make notations on the map. Additionally, the map requires being carried and reviewed constantly while a visitor navigates and walks a convention floor. The map tends to become worn out from constant handling, and requires a visitor to carry the map (either in their hand, in a bag, or in a pocket) and reference the map with their hands. A visitor collects samples and brochures, which also requires either hands or pockets to carry, and carrying the map can then become a nuisance in and of itself. Placing the map in a bag or pocket with exhibitor literature, only to be retrieved a short time later, also becomes a nuisance.

Another manner for navigating a convention floor is by providing some type of hand-held device. While the hand-held device may include a map, it nonetheless is definitionally a hand-held device and presents the same issues to a visitor's ability to have their hands free to carry exhibitor literature, greet others by shaking hands, or manually inspect an exhibitor's wares. In order for the hand-held device to be more active in navigation, regardless of the manner operation thereof, notification to a visitor is necessarily done either by an audible sound or a vibration, as is known for cellular telephones and hand-held device technologies. In the din and roar of a convention hall, an audible sound may not be heard, or may not be recognized by a visitor as coming from their own device, and certainly adds to the cacophony of the environment. With respect to vibration, a visitor has to rely on the hand-held device being present in their hand or otherwise close to their body so that the vibration is recognized. If the vibrating device is placed in a bag, or placed in a pocket with literature between the device and the person's body, the efficacy and utility of the device is greatly diminished if not nullified.

Accordingly, there has been a need for improved methods and apparatus for providing a booth at an exposition or convention, for tailoring an exhibit to different groups of visitors, and for assisting in navigation of a convention center or hall.

SUMMARY

In accordance with an aspect, a convention center for hosting conventions having a plurality of exhibitors and visitors is disclosed, the convention center including a convention hall having a floor structure, a plurality of walls permanently arranged on the floor structure to define booths for respective exhibits of respective exhibitors, electrical connections provided in each booth, communications connections provided in each booth, and at least one display permanently mounted and provided for each booth, wherein an exhibitor presentation including at least a visual presentation particular to the respective exhibit of each booth is presented on the display to the visitors.

In one form, the convention center further include a computer network, wherein the computer network includes a program module, and the exhibitor presentation is stored on the program module, and the program module delivers the exhibitor presentation to the display.

In another form, the convention center further includes a computer network, wherein the computer network communicates with an exhibitor storage device to upload the exhibitor presentation to the computer network. The exhibitor storage device may be a remotely-located computer, and the computer network communicates via the Internet to the remotely-located computer for uploading the exhibitor presentation therefrom. The computer network may include a central host computer including a program module for storing the exhibitor presentation received from the exhibitor storage device, and the program module delivers the exhibitor presentation to the display. The computer network may include a central host computer and a locally-resident computer, wherein the exhibitor presentation may be uploaded from the exhibitor storage device to the central host computer, the central host computer transmits the uploaded exhibitor presentation to the locally-resident computer, and the locally-resident computer delivers one or more exhibitor presentations to one or more displays of one or more booths for presenting the exhibitor presentation thereon.

In another form, the convention center further includes a computer network for communicating with a remotely-located computer for presenting the exhibitor presentation on the remotely-located computer. The computer network may host bidding for booths, bidding being made via the remotely-located computer. The computer network may be capable of receiving information regarding booths to be visited by a visitor from the remotely-located computer, and the computer network is capable of providing a navigational route for the convention based on the information received.

In another form, the convention center further includes identification provided to visitors, and a computer network, wherein the computer network is capable of receiving visitor information based on the identification. The visitor information may include tracking information for determining foot traffic information. The foot traffic information may be incorporated into a bidding for the booths. The presentations displayed in the booths may be determined by the identification of the visitor to the booth. The identification may include an RFID for communicating with the convention center to provide the visitor information.

In another aspect, a convention center for hosting conventions having a plurality of exhibitors and visitors is disclosed, the convention center including a convention hall having a floor structure, a plurality of booths for respective exhibits of respective exhibitors, displays located in the hall for presenting information to visitors, identification provided for at least the visitors to the conventions, and an ID receiver system for receiving visitor information from the identification.

In some forms, the convention center includes a computer network, wherein the ID receiver system communicates with the computer network, and the computer network provides notification to the booth of the visitor information.

In some forms, the booths include exhibitor displays for presenting respective exhibitor presentations, and the computer network directs the appropriate exhibitor presentation to be presented to the visitor based on the visitor information.

In some forms, the visitor information includes identity and location of the visitor, and the displays are capable of presenting navigational information to the visitor based on the visitor information.

In some forms, the convention center further includes a computer network, wherein the visitor may identify to the computer network which exhibits are to be visited by the visitor. The ID receiver may be capable of providing the computer network with the visitor information, and the computer network may be capable of providing notification to the visitor of one or more of a navigational route, deviation from the navigational route, booths of interest to the visitor, and a level of interest of a booth the visitor. The notification may be presented to the visitor on the displays.

In another aspect, a method of providing a convention center for hosting conventions having a plurality of exhibitors and visitors is disclosed, the method including the steps of providing a convention hall at the convention center having a floor structure, permanently arranging a plurality of walls on the floor structure to define booths for respective exhibits of respective exhibitors, providing at least one display permanently mounted for each booth, and presenting an exhibitor presentation including at least a visual presentation particular to the respective exhibit of each booth on the display to the visitors.

In some forms, the method further including the steps of providing a computer network includes a program module, storing the exhibitor presentation on the program module, and delivering the exhibitor presentation to the display from the program module.

In some forms, the method further includes the steps of providing a computer network, and uploading the exhibitor presentation from an exhibitor storage device to the computer network prior to the convention. The method may further include utilizing the Internet to upload the exhibitor presentation from the exhibitor storage device, the exhibitor storage device being a remotely-located computer. The step of providing a computer network may include providing a central host computer having a program module, the steps may further include storing the exhibitor presentation on the program module, and delivering the exhibitor presentation to the display via the program module. The step of providing the computer network may include providing a central host computer and a locally-resident computer, the step of uploading the exhibitor presentation may include uploading the exhibitor presentation from the exhibitor storage device to the central host computer, and the method may further include the steps of the central host computer transmitting the uploaded exhibitor presentation to the locally-resident computer, and the step of the locally-resident computer delivering one or more exhibitor presentations to one or more displays of one or more booths for presenting the exhibitor presentation on the displays.

In some forms, the method further includes the step of hosting bidding for booths, bidding being made via a remotely-located computer.

In some forms, the method further includes the steps of receiving information regarding booths to be visited by a visitor from a remotely-located computer, and providing a navigational route for the convention based on the said received information.

In some forms, the method further includes the steps of providing identification provided to visitors, providing a computer network, and the computer network receiving visitor information based on the identification. The method may further include the step of determining foot traffic information based on said received visitor information. The method may further include the steps of hosting bidding for booths, bidding being made via a remotely-located computer, and incorporating the foot traffic information into the bidding.

In some forms, the step of presenting exhibitor presentations displayed in the booths includes identifying at least a class of the visitor to the booth via the identification.

In a further aspect, a method of providing a convention center for hosting conventions having a plurality of exhibitors and visitors is disclosed, the method including the steps of providing a convention hall having a floor structure, providing a plurality of booths for respective exhibits of respective exhibitors, providing displays located in the hall for presenting information to visitors, providing identification for at least the visitors to the conventions, and an ID receiver system receiving visitor information from the identification.

In some forms, the method further include the steps of providing a computer network, communicating the visitor information to the computer network, and providing notification to the booth of the visitor information. The method may further include the step of presenting appropriately selected exhibitor presentations to the visitor based on the visitor information. The method may further include the step of presenting navigational information to the visitor based on the visitor information.

In some forms, the method further include the steps of providing a computer network, the visitor identifying to the computer network exhibits to be visited by the visitor, the ID receiver providing the computer network with the visitor information, and the computer network providing notification to the visitor of one or more of a navigational route, deviation from the navigational route, booths of interest to the visitor, and a level of interest of a booth the visitor, such notification being based on said exhibits to be visited and on the visitor information.

DETAILED DESCRIPTION

Figure 1:
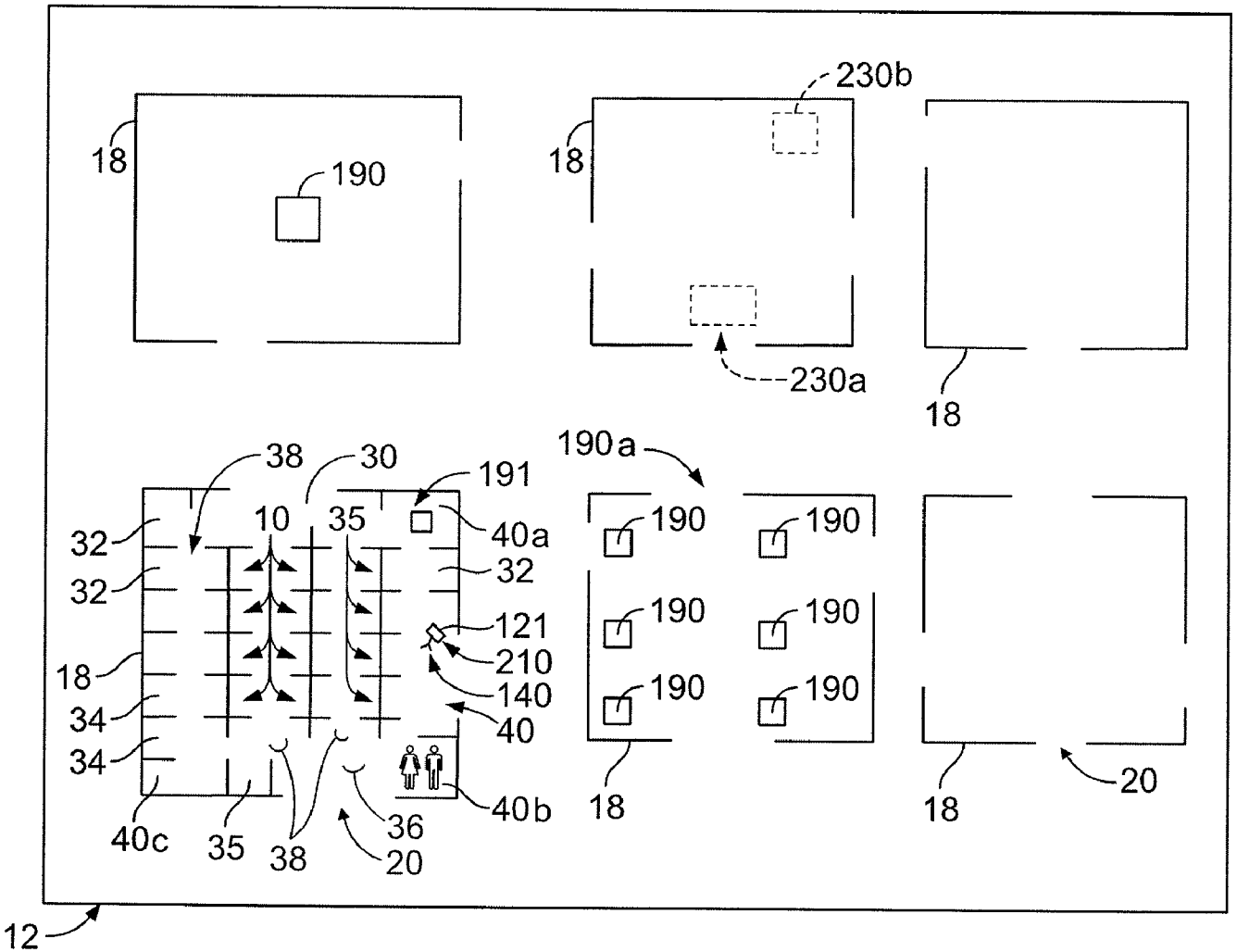
FIG. 1 is plan schematic overview of a convention center having a plurality of defined areas for use as one or more convention halls, each of the halls having a plurality of booths as is shown in a first of the halls to define booth sizes and areas and locations as well as to define an arrangement of booths and aisle, each of the halls having an ID receiving system for receiving information from identification worn by visitors as is shown in second and third of the halls, and each of the halls having various foot traffic areas including high and low traffic areas as shown in a fourth of the halls.

Referring to the Figs., the presently disclosed inventions encompass improved methods and apparatus for providing a booth 10 hosted by an exhibitor 11 at an exposition or convention center 12, for tailoring an exhibit 14 in the booth 10 to different groups of visitors 16, and for assisting in navigation of a convention hall 18 at the convention center 12 hosting a convention 20 or exposition.

As can be seen in FIG. 1, in one aspect, the convention hall 18 provides permanent booths 10. As used herein, the use of the term hall 18 refers to one or more rooms or spaces of the convention center 12 used for a particular convention 20. The hall 18 includes a floor structure 30 and designated booths 10 each having a predetermined size 32 and a predetermined area 34 and a predetermined location 35, and the booths 10 collectively provide a predetermined arrangement 36 within the hall 18. The predetermined size 32 can be a variety of sizes such as, by mere example, 10 feet by 8 feet, 10 feet by 12 feet, 12 feet by 18 feet. The arrangement 36 defines aisles 38 and provides for common usage areas 40 such as food vendors 40*a*, restrooms 40*b*, an information desk or directory 40*c*, etc.

The floor structure 30 supports use of necessary or desired utilities 42 by the booths 10. Towards this end, the floor structure 30 has access panels 44, which may have a door or plate that is opened or removed, for access to the utilities 42, such as electrical connections 46, plumbing connections 48, and communications connections 50.

Figure 2:
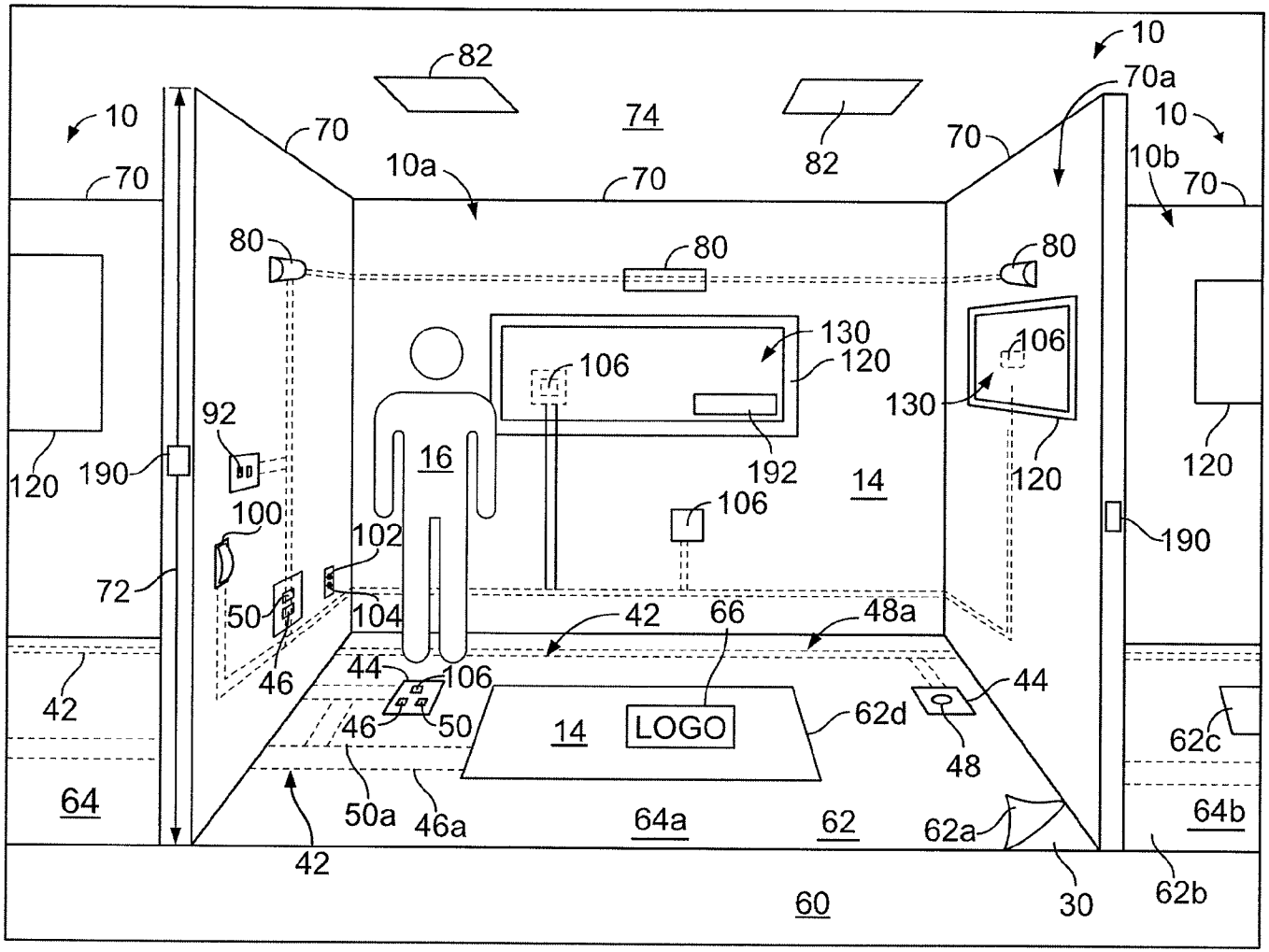
FIG. 2 is a representative view of a booth of the convention center for an exhibit of an exhibitor and a visitor to the booth, one or more displays mounted in the booth for showing presentations transmitted to the booth via communications connections with a computer network, and the booth having permanent walls for defining the booth.
Figure 3A:
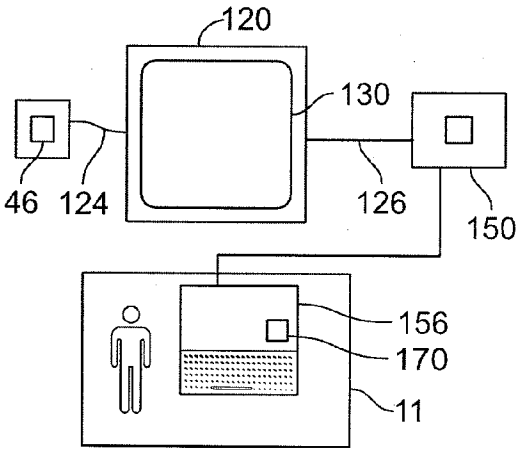
FIGS. 3A-3F are representational views of arrangements of a display for showing presentations thereon connected with a power source and connected via a feed cable for receiving a presentation, the feed cable connecting with various components permitting uploading, storage, and delivery of the presentations to the display.
Figure 3B:
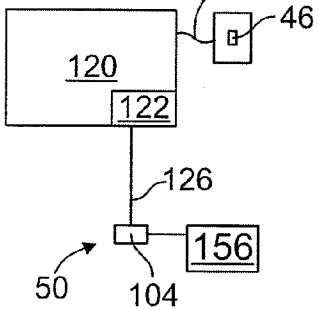
Figure 3C:
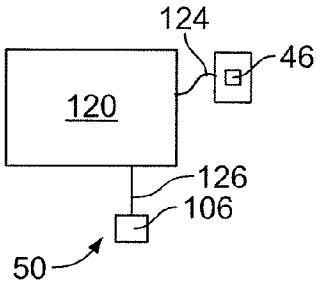
Figure 3D:
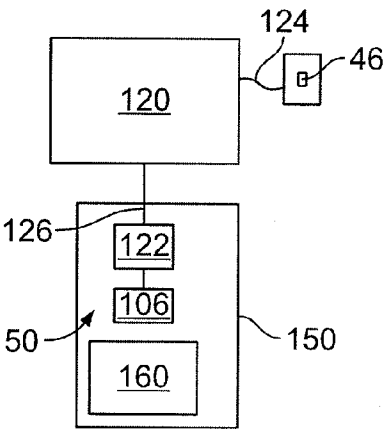
Figure 3E:
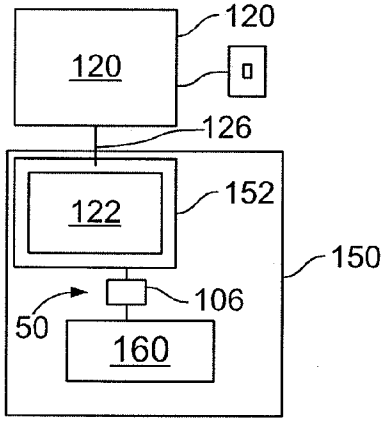
Figure 3F:
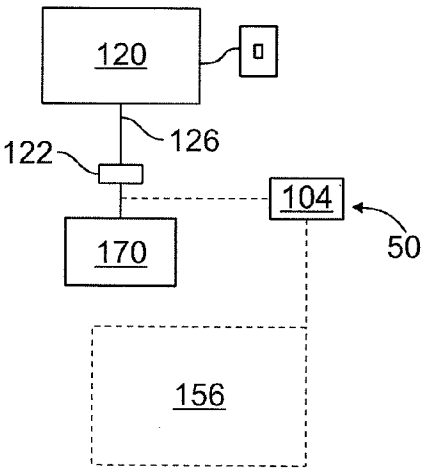
Figure 6:
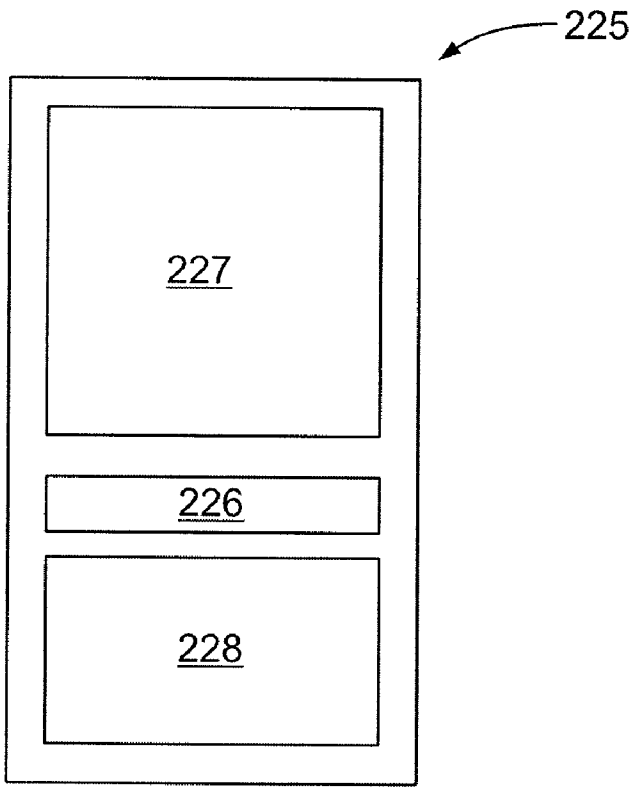
FIG. 6 is a representational view of a navigation device for controlling presentations by exhibitor personnel at a booth.
Figure 4:
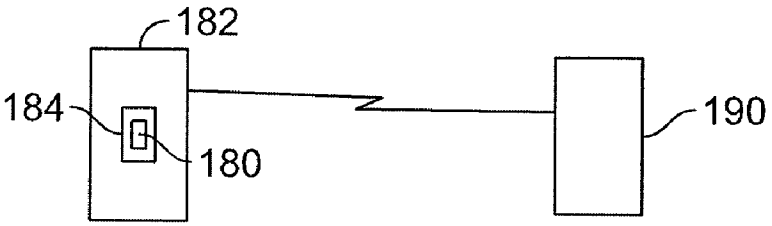
FIG. 4 is a representational view of variety of an identification such as an identification tag worn by a visitor having an RFID device therein for communicating with or transmitting to an ID panel of the ID receiver system.
Figure 5:
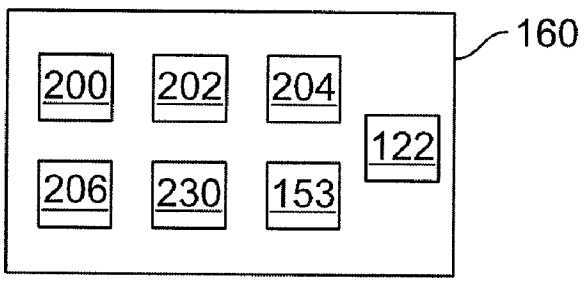
FIG. 5 is a representational view of a central host computer and functions supported thereat for providing navigational information to a visitor.

As can be seen in FIG. 2, the floor structure 30 is preferably covered with carpeting 60. In a preferred form, the carpeting 60 is provided in sections 62 corresponding to the booths 10 so that a first section 62*a* having a first color or texture 64*a* is installed in a first booth 10*a*, and a second section 62*b* having a second color or texture 64*b* is installed in a second booth 10*b*, and so on, so that colors or textures 64 highlight different booths 10. Additionally, by the carpeting 60 being provided in sections 62, a particular section such as section 62*c* may be removed and temporarily replaced with a customized carpeting 62*d*, which may display a logo 66 of the exhibitor 11 at the booth 10.

The hall 12 has generally permanent or semi-permanent walls 70 defining the area 34 and size 32 of the booths 10. The walls 70 extend from the floor structure 30 upward, and different booths 10 may utilize walls 70 of different heights 72 to provide further distinction between the booths 10. In another form, some or all of the walls 70 may extend from the floor structure 30 all the way to a ceiling 74.

Different permanent utilities 42 may be supported by the booth 10. Preferably, electrical utilities 42 are routed through and mounted in the walls 70 to provide electrical connections 46, such as power outlets, on the walls 70. The electrical connections 46 are used to power all electrical needs of the booth 10 during the convention show. Additionally, the electrical utilities 42 are routed through and mounted in the walls 70 to connect with semi-permanent or permanent lighting 80. The lighting 80 may be hardwired (permanent) or plugged into electrical connections 46 provided on the walls 70 (semi-permanent).

It should be noted that, preferably, additional lighting 82 is provided above the booth 10. The additional lighting 82 may supported by any structure such as, as mere examples, a roof or floor support structure, girders or rafters supporting the roof or floor support structure, scaffolding structures, drop-panel ceiling, or from an upper portion 70*a* of the walls 70 themselves, such as by flying the lighting 82 over the booth 10. Utilities 42, and specifically electrical utilities 42, may be routed to the additional lighting in a variety of manners, including through the ceiling 74 or through the walls 70. The lighting 80 and additional lighting 82 provide a selection of primary, secondary, and tertiary lighting conditions that can be controlled by electrical switches 92 located in the booth 10, such as on one of the walls 70 to allow easy customization for an exhibitor 11 without the need for customized installation.

The plumbing connections 48 may be routed and installed within the walls 70, in addition to the floor structure 30.

Communications connections 50 may be routed and installed within the walls 70 as well. The communications connections 50 may be used in a variety of manners, including for a hardwired telephone 100, a dedicated Internet connection 102, a local-area-network (LAN) connection 104, and audio/visual connections 106. As shown in FIG. 2, communication lines 50*a* for the communications connections 50 are routed with electrical lines 46*a* for the electrical connections 46, while plumbing lines 48*a* are routed separately for the plumbing connections 48.

The booth 10 is provided with one or more permanently or semi-permanently mounted displays 120. The displays 120 may be monitors (video displays not having a tuner), television sets (video displays having a tuner), programmable electronic signage, other types of displays that support presentation of at least visual information, or a combination thereof. The programmable electronic signage may also be, in industry terms, changeable message signs, dynamic message signs, and variable message signs. More particularly, the displays 120 are programmable to show one or more customized presentations 130 tailored not just for the exhibitor 11 but also for classes of visitors 16, as will be discussed below. To be clear, the displays 120 (or displays 121, discussed below) may present be split so that any particular display 120, 121 may simultaneously show information tailored to a plurality of visitors 16, to a plurality of exhibitors 11, or general information, in any combination.

Each display 120 receives presentations 130, discussed below, and, towards this end, each display 120 either includes a program module 122 or is connected to a program box 125 having a program module 122 therewithin, as will be discussed in additional detail below. In basic terms, the program module 122 is a storage device or medium capable of receiving, storing, and delivering information stored thereon, or is a device capable of being coupled with other devices for achieving the same. For electrical power, it is preferred that the display includes a power cable 124. A feed cable 126 may also be provided, which is used in the event the program module 122 is separate from the display 120, or the presentations 130 are delivered to the display 120 from another source, as will be discussed below.

The displays 120 are mounted or suspended for viewing in or proximate to the booth 10, preferably being hung on the walls 70, though they may also be suspended from other booth or ceiling structures, detailed above. Additionally, the display 120 may simply be supported by a floor-supported structure 140, such as a support pole, which preferably encases the power cable 124 and/or feed cable 126 to provide the display 120/structure 140 with a clean aesthetic.

The feed cable 126 provides the presentations 130 in electronic-format to the display for presenting to the visitors 16. The feed cable 126 may be a common co-axial cable, an RCA cable, an HDMI cable, an S-Video cable, or any one of a variety of cables used for transmitting a video and/or audio signal to displays 120. In particular, the feed cable 126 is preferably capable of connecting the display 120 with a computer 152 or computer network 150, as will be described below, for receiving information therefrom (such as from the program module 122 if such is part of the computer network 150).

In the preferred form, the exhibitor 11 transmits or uploads one or more presentations 130 (audio and/or visual presentations) to be presented on the display 120 during the show. The exhibitor 11 utilizes a storage device or medium 170 such as a computer or computing device (such as an IPod), CD-ROMs, and chip-operated drives commonly referred to as flash drives or USB plugs/drives. In the preferred form, the exhibitor 11 utilizes a personal remotely-located computer 156, and connects to the computer network In one form, a single program module 122 may support any number of displays 120, including a single display 120 or a plurality of displays 120 in one or more booths 10.

The presentations 130 may be uploaded in a number of manners. Broadly speaking, the presentations 130 are uploaded to the program module 122 associated with the display 120. In one form, the program module 122 is located as part of the display 120, or otherwise locally-resident in the booth 10 such as within a locally-resident computer 152. In a more preferred form, the hall 18 is provided with an underlying computer network 150 to which exhibitors 11 are able to upload their presentations 130, and the network 150 may include the locally-resident computer 152. The display 120 is operatively connected to the network 150 via the feed cable 126 for receiving the presentations from the network 150. More specifically, the display 120 is connected to and in communications with the network 150 initially via the feed cable 126, and ultimately with the program module 122 (where the presentations 130 are stored). The network 150 initially receives the uploaded presentations 130 (such as in the event is uploaded from a remote computer in electronic format via the Internet). The network 150, in turn, may retain the presentations 130 thereon for delivery and central deletion at the conclusion of the convention 20, or may proceed to deliver the presentations 130 to the locally-resident computer 152 for storage and usage during the convention 20; in a further form, it may do both. In a further form, the presentations 130 may be stored remotely from the convention center 12, and are delivered (such as via streaming video from a remotely located server) through the communications connections 50 to the display 120.

In greater detail, it is desirable to permit an exhibitor 11 or personnel thereof to view the booth 10 and presentation 130 prior to the convention 20, and preferably do so remotely. As the exhibitor 11 is able to upload the presentation 130 via the Internet using an exhibitor or remote computer 156, the network 150 is able to play or otherwise transmit a video stream to the exhibitor 11 for display on the remote computer 156. The video stream visually the actual presentation 130 and, preferably, the booth 10 itself with the presentation 130 playing therein/thereat, and areas surrounding the booth 10. This allows a prospective exhibitor 11 to, in essence, trial or demo a convention (or, minimally, their own booth) prior to contracting to be an actual exhibitor or before selecting a particular booth 10, which may include bidding on the booth 10, discussed in greater detail below. Additionally, uploading of presentations 130 prior to arrival at the convention hall 18 reduces the lead time required for exhibitor personnel.

In a more complex form, the computer network 150 may include one or more host computers 160 that serve as a central repository for a plurality of presentations 130 for multiple booths 10, and the host computers 160 communicate or deliver the presentations 130 for display on the displays 120 at the multiple booths 10 at least during the show. The host computer 160 can serve as a central collection point for exhibitors 110 to upload their presentations 130, facilitated by hall personnel.

The computer network 150 permits third-parties to view the convention 20 and convention hall 18, generally, and the presentations 130 and booths 10, specifically, prior to arrival at the hall 18, as well as during the convention 20. For instance, a brief viewing of representative booths 10 may be shown to third-parties who are considering attending/visiting the convention, a viewing may be provided to third-parties who have already registered for the convention (with or without registration fee, if applicable) so that they can identify and target booths 10 or exhibitors 11 they wish to visit, or a viewing may be shown to exhibitors 110 to target booths 10 of other exhibitors 11 they wish to visit and inspect. It is noted that it is not uncommon for a first exhibitor to seek injunctive relief against a second exhibitor whom they believe is showing a product or disclosing information in violation of the first exhibitor's intellectual property rights: the use of this aspect would allow the first exhibitor to inspect the second exhibitor's booth prior to the show beginning, thereby facilitating the protection of intellectual property rights. It is also noted that previewing of the booths 10 by exhibitors 11 decreases the total man-hours for exhibitor personnel at the convention, as little to no time need be dedicated to activities outside the exhibitor's booth 10. It is also noted that the presentations 130 and previews, as well as video and audio of the convention hall 18, may be maintained for a period after the convention ends so that people can virtually return to the convention, as desired.

As noted above, an exhibitor 11 may upload multiple presentations 130 for display on one or more displays 120, either simultaneously or selectively. In a form, the booths 10 may recognize a particular visitor 16 to the booth and tailor the displays 120 and/or select the presentations 130 based on that specific visitor 16. Specifically, the booth 10 (or components thereof) may recognize a presence and a class 180 of the visitor 16. As discussed above, the class 180 of the visitor 16 relates to the function or purpose of the visitor 16 at the convention 20 relative to the exhibitor 11, such as that of a competitor, a buyer, business alliance partner, vendor, journalist, etc. The presentation 130 displayed on the display 120 is based on the identified class or personal identity of the visitor 16. It is also noted that the one of the displays 120, or other displays 121 unrelated to any booth 100, may also present information that is particular to the visitor 16 that is unrelated to any exhibitor 11, such as notifying the visitor 16 that he/she is being paged, or that they have deviated from a pre-determined route 204 through the convention hall 18, as described in greater detail below. When multiple visitors 16 are present in a booth 10, a display 120 may provide a split image so that two presentations are currently presented to the separate visitors 16, such as when the identified class of visitors 16 are different or when it is desired to simply show a second-arriving visitor the presentation 130 from the beginning thereof. In some forms, multiple displays 120 within the booth 10 can be utilized for the same purposes.

Towards this end, the visitor 16 is provided with an identification device (ID) 182 that communicates with the booth 10. The ID 182 includes a communication device 184 preferably in the form of a radio frequency identification device (RFID), as an example, which communicates with an ID receiver 190 installed in or proximate to the booth 10. The RFID 184 may be a powered RFID so that the broadcast/receptivity range is increased, in the order of 10-12 feet from the panel 190. This enables the visitor 16 wearing the ID 182 to be identified by the booth 10. The booth 10 or one of the displays 120, for instance, can alert exhibitor personnel stationed at the booth 10 so that the personnel can recognize a job or industry function or class 180 of the visitor 16 and tailor a conversation with the visitor 16 accordingly. As noted, a plurality of presentations 130 can be pre-loaded, and the presentation 130 most applicable to the specific visitor 16 can automatically be displayed upon recognition of the visitor 16, either personally or based on class 180.

More broadly, the ID receiver 190 may be an ID receiver system **190*a* including a plurality of separate ID receivers 190. The ID receivers 190 may be located at each booth 10, may be distributed throughout the hall 18, or may be provided as a single, master ID receiver 190 operating in a multiplexed manner and operating in on triangulation principles within the hall. As such, the hall 18 may include three or more positioning ID receivers 191 strategically placed throughout the hall 18 for determining the position of each visitor 16 at any given time. As such, the ID 182 is a broadcasting-type device for transmitting a signal to the ID receivers 191, or for two-way communication with the ID receiver system 190*a*. The ID receivers 191 communicate with the computer network 150 so that the appropriately selected presentations 130 (or other messages) are displayed to the visitors 16, particularly when entering or approaching a particular booth 10**.

As briefly noted, the visitor 16 can utilize the ID 182 in other manners. For instance, it is discussed above that the visitor 16 preview the booths 10 and/or presentations 130 prior to arrival, such as via the Internet. Therefore, the visitor 160 can identify which booths 10 and exhibitors 11 the visitor 16 seeks to visit, prior to arrival at the convention. This information can be uploaded or otherwise provided to the computer network 150 so that, upon nearing a particular booth 10, the visitor 16 can be notified that such particular booth 10 has been determined to be of interest. For instance, a display 120, 121 may, upon the visitor 16 being recognized, provide a visual or other indication 192 to the visitor 16 that the booth 10 is of interest. The indication 192 may also including a level of interest, such as high interest, moderate interest, slight interest, or other relevant information regarding the exhibitor 11 such as competitor or possible supplier or possible purchaser.

Finally, the displays 120, 121 may provide mapping or navigation information 200. The visitor 16 may determine desired booths 10 to be visited and may determine a ranking 202 of importance of the booths 10. This information (booths 10 and ranking 202) can be used by the visitor 16 to upload their own mapping or navigation route through the convention hall 18, or this information (booths 10 and ranking 202) can be uploaded to allow the computer network 150, for instance, to determine a navigation route 204. In one form, the computer network 150 may create a dynamic navigation route 206 by tracking movements of the visitor 16, alerting the visitor 16 that a pre-selected booth 10 of interest is being skipped, and providing directions and alternatives for the visitor 16 to change the order of booths 10 visited, as mere examples. As noted, all of this information can be provided to the visitor 16 on the booth-specific displays 120 or on the secondary displays 121 in various locations 210 in the hall 18.

It should be noted that many of these features may also be achieved with an ID 182 in the form of a hand-held or other transmitting device, such as a cellular phone, so-called smartphone, personal data assistant, or push-type device such as a Blackberry. Such other ID 182 devices may utilize another type of indicator to a visitor 16, such as an audible noise or a vibration, to notify the visitor 16 of the above-discussed relevant information (such as a particular booth 10 being of interest, or that the visitor 16 has strayed from a predetermined mapping route 204, either displaying such on a screen 220 of the ID 182 or simply as a prompt to look at nearby displays 120, 121, inside or outside of booths 10). However, the communication device 184 in the form of an RFID may be incorporated into a nametag 184*a* that can be pinned or secured to a person's clothing and, thus, has the benefit of not requiring the use of the visitor's hands or pockets.

While the particular presentation 130 shown to a visitor 16 upon entering a booth 10 can be controlled or prompted by the ID 182 being identified, it is preferred to allow an exhibitor 11 to control the presentation 130 itself. That is, a presentation 130 that is composed of a series or slides or perhaps includes selection choices may be navigated by the exhibitor personnel, such as by using a navigation device 225 which, in a preferred form, is a wireless-capable device and, more preferably, is a wireless Internet-capable device, such as personal data assistant (PDA), smart phone (such as a Blackberry or an iPhone). The device 225 may have designated buttons or controls 226 for operating the device 225, thereby reducing or eliminating the need for a conventional keyboard (though a miniature keyboard 228 may be provided) and allowing customizable applications to be created for ease of controlling via the device 225. Exhibitor personnel can hold and operate the device 225 in one hand and quickly and easily navigate the presentation 130 without needing to look at the device 225. The device 225 preferably includes a screen display 227 so that information regarding the visitor 16 (such as job function or, as will be discussed below, name and contact information) may be shown to the exhibitor personnel with a high-degree of privacy. Among other benefits, this also allows the exhibitor personnel to prioritize how much time is spent talking to a visitor 16.

It should be noted that the screen display 227 may be a touch screen, such as is provided for the iPhone, for instance, so that the need for buttons 226 may be obviated. Using either the touch screen 227 or other inputs (buttons 226, keyboard 228), annotations regarding a particular visitor 16 may be made.

Due to the networkable capabilities of the presentations 130 (which may be viewed via the Internet, as discussed) and of the device 225, it is clear that exhibitor personnel can practice and navigate the presentations 130 from anywhere that provides the necessary communications access.

Many visitors 16 may have a privacy concern with the use of the ID 182. For instance, a visitor 16 may be concerned about an employer reviewing their movement during the convention 20, the visitor 16 having to explain why they spent two hours in an area where alcoholic beverages were available, when the visitor 16 may have been pursuing a hot lead. The hall 18 may provide logon privileges and privacy settings for a visitor 16 and their ID 182. For instance, a visitor 16 may use a logon and password to access a historical view of their path in the hall 18, assisting the visitor 16 in remembering what booths 10 were visited, for instance. Preferably, the visitor 16 may designate a time period after which such information is automatically deleted from records.

Additionally, the visitor 16 may provide a number of predetermined settings relative to booth visits. For instance, the visitor 16 may select that the exhibitor 11 is not to be informed automatically of the visitor's identity, such as a personal name, but preferably still requiring their job function be disclosed. In this manner, a visitor 16 can inhibit or stop altogether undesirable solicitations or spam. The visitor 16 may also select a time period for visiting a booth 10, upon which personal information (such as name and contact information) are automatically transferred to the exhibitor 11 for later retrieval. Additionally, a display 120 may provide a visual indicator to the visitor 16 that their information is about to be transmitted to the exhibitor 11, giving the visitor 16 the opportunity to leave the booth 10 prior to such happening. This allows the exhibitors 11 to be able to automatically collect information from those who are amenable to being contacted while also allowing the visitors 16 a large measure of control over the dissemination of such information.

Alternatively, exhibitors 11 may receive, automatically or by request, information for visitors 16, but that information includes an alias email address. The exhibitors 11 and/or visitors 16 may use the alias email address a predetermined number of times (once or twice, for instance) or for a predetermined amount of time (such as two weeks from the end of the convention), messages from the exhibitors 11 being routed through the network 150 (for instance), and delivered to the real email address for the visitor 16. If the visitor 16 desires the contact, they can reply; if no reply is made within a set period of time, the address expires.

The visitor 16 and/or exhibitor 11 may also set other predetermined parameters so that time is effectively used at the convention 20. For instance, the visitor 16 may provide a predetermined setting to either the ID 182 directly or the network 150 communicating with the ID 182 that alerts the visitor 16 that a visit to a particular booth 10 is reaching has exceeded a predetermined time (such as 1 minute, 5 minutes, etc.) for a booth visit. In another form, the display 120 may alert the visitor 16 of the time limit. Obviously, the visitor 16 would be free to ignore (or 'snooze') the alert. In some forms, either the ID 182 or the display 120 or some other device may provide a visual or auditory countdown. The exhibitor 11, for their part, may provide the network 150 or some other feature local to the booth 10 (such as the locally-resident computer 152) with a time limit (again, 1 minute, 5 minutes, etc.) so that the exhibitor personnel are alerted that they have spent a sufficient amount of time with a particular visitor 16 and should move on to another visitor 16. In one form, a timer may be presented on one of the displays 120, 121. Both the exhibitor 11 and visitor 16 may be provided with default time limits, and each may set their own time limits, including time limits for particular booths or visitors of special interest.

The use of the ID 182 allows the hall 18 to track foot-traffic 230 and other parameters. This allows the hall 18 to identify what are high foot-traffic 230*a* spots, low foot-traffic spots 230*b*, and everything in between.

The hall 18 can use this information in a variety of manners. In one form, the foot-traffic 230 information can be used to determine traffic-flow patterns that may advantageously adjusted for better traffic flow. The foot-traffic 230 data may be used to recognize whether different locations for food vendors, for instance, has any bearing on traffic patterns.

From the perspective of the hall 18, the goals are to optimize revenues for conventions 20 and to optimize performance of the hall 18 so that exhibitors 11 and visitors 16 consider the hall 18 a positive environment for a convention 20, and so that exhibitors 11 and visitors 16 feel the cost of attendance has a positive cost-benefit analysis. By identifying traffic patterns and volume (by tracking the foot-traffic 230), particular booths 10 can be offered, auctioned, or otherwise bid on, based on anticipated foot-traffic 230, with data to support the cost or value or demand associated with each particular booth 10. The computer network 150, accordingly, includes a bidding platform 153. Additionally, prior to bidding on a particular booth 10, the potential exhibitor 11 is able to load their presentation(s) 130 to the computer network 150, as discussed above, thus enabling the potential exhibitor 11 to make a more informed decision on the value of different booths 10. In different forms, the hall 18 or computer network 150 thereof may or may not display to potential exhibitors 11 the identity of, or a preview of presentations for, any other exhibitors 11 that are bidding on or have secured a booth 10.

In an example, the present invention includes a bid-per-location feature. That is, as discussed, the location and size of the booths 10 is generally predetermined, and the foot-traffic data 230 can determine relative values for the booths 10. Exhibitors are typically desirous to have the most foot traffic, and/or the foot traffic that tends to linger (since it should be clear that being near a restroom would likely result in high foot traffic, but not necessarily foot traffic that spends time at a booth 10). In a form, exhibitors 11 can bid any amount above a preset base figure for a particular booth 10 having a specific location, as described above. Alternatively, an exhibitor 11 can simply supply an amount the exhibitor 11 is willing to pay, and would receive the best booth 10 available for that highest bid, based on the overall demand for the booths 10. The overall highest bidder (exhibitor 11) would receive the most desirable booth 10 on the day the booth auction ends, the second highest bidder would receive the second most desirable booth 10, and so on. All functions including bidding and record keeping and notification, etc., are stored and located within the bidding platform 153.

As an extension of the bidding platform 153, the convention center 12 may incentivize exhibitors 11 to commit early to attending a convention 20. For instance, the convention center 12 may auction a first allotment or grouping of booths 10 well in advance of a convention 20, and auction a subsequent grouping later. In greater detail, the convention center 12 may recognize a relative desirability of the booths 10 and designate a grouping of a top portion thereof, such as the 25 most desirable booths 10. These first-tier booths 10 may be auctioned a predetermined time period in advance of the convention 20, and prior to the auction of other booths 10. Once the first tier booths 10 have been auctioned, a second tier (i.e., the booths 10 ranked 26-50 in terms of desirability) may be auctioned. In this manner, the earlier you commit to a trade show, the more choices you have for booth locations. Booths 10 may be grouped for various auctions in a variety of manners other than foot traffic, such as by similar qualities (i.e., size), and then ranked within the grouping by another factor (such as foot traffic) such that the bidders simply bid for a booth of a particular grouping, and the bidders receive the booth within that grouping based on the ranking of the booths compared to the bidder's bid rank. That is, the highest bidder would get the most desirable booth of a grouping, and the second highest bidder would get the second most desirable booth of the grouping.

While in the past, convention centers book a particular exhibitor based on seniority due to a general inability to determine who is 'first' in line for a particular booth, the present method and bidding platform 153 organizes the demand and allows the highest bidder of the exhibitors 11 to receive the premier booths 10. In the prior art, convention centers attempt to make appointments with the exhibitors 11 to book next year's attendance at the show, and the convention centers try to rank the exhibitors 11 based on seniority and/or dollars spent at the convention 20; the present method and bidding platform 153 prevent senior exhibitors from missing appointments, and still retain the ability to book their preferred booth 10.

It should also be noted that the bidding platform 153 may be operated by the convention center 12 or by a promoter, for instance. In any event, the operator of the bidding platform 153 may also be incentivized, such as by paying a fee to the operator for value added by the auction, so as a percentage of an increase in exhibitor fees compared to a previous year's fees.

The remote capabilities of the convention center 12 can also be leveraged to provide communications with remote persons. For instance, an engineer having more technical knowledge than a sales person may be made available via a teleconference system, such as an Internet-based system utilizing the network 150, so that a tech-oriented visitor 16 may be patched through to the engineer quickly and easily when such visitor 16 visits the booth 10. In this manner, all forms of personnel that are not in attendance at the convention 20 may nonetheless be utilized in promoting the exhibitor's goods, services, etc. Additionally, all persons present at that the convention 20 (such as exhibitor personnel and visitor 16) may access the network 150 to input or record data for future use, such as a list of booths 10 to which a visitor 16 may consider a second visit or notes made by an exhibitor 11 relevant to a specific visitor 16, or vice versa.

It should be noted that other aspects of traditional convention booths may be employed. For instance, while a great many aspects of needless cost have been eliminated in comparison to a traditional convention, an exhibitor 11 may desire to bring in banners, or other items, at their whim.

Accordingly, a number of novel features are disclosed herein. The generally permanent booths 10 are provided at a convention hall 18 so that every booth 10 need not be installed for every convention 20, as is required by the prior art. This vastly reduces the cost and burden of set-up (in terms of labor and materials and time), and eliminates a significant amount of waste (as materials and labor is not thrown out after every show).

The use of various features of the booths 10, described herein, allow for uploading of presentations 130 prior to the show, with numerous benefits. The presentation 130 can be viewed remotely, can be stored and previewed before the convention 20 or reviewed after the 20, and can be used as a preview for potential or actual visitors 16. An exhibitor 11 can view a booth 10 prior to the convention 20, as well as preview how the presentation 130 is displayed prior to arriving and even prior to agreeing to participate in the convention 20.

Prior to agreeing to participate in the convention 20, exhibitors 11 can bid on booth 10. Exhibitor bidding, or convention center 12 pricing, can be based on true foot traffic 230 data. The exhibitors 11 can view the booth 10 as it will appear with their loaded presentations 130 prior to bidding, as well as those in the surrounding area, to make a more informed choice of whether to participate in a convention 20, what degree their financial commitment (i.e., booth bid) is for participating, and to ensure that a presentation 130 will effectively be displayed at the convention 20.

The convention hall 18 recognizes the presence and movement of visitors 16 via the ID 182, thus providing the foot traffic 230 data. The booths 10 and the hall 18 can be provided with displays 120, 121, that provide information to visitors 16 to assist their navigation route 204, or provide other information, based on the presence and movement of the visitors 16. Additionally, the displays 120 can provide presentations 130 tailored toward a specific visitor 16 and/or that visitor's class 180.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An apparatus comprising:

at least one booth for a respective exhibit of a respective convention center exhibitor;

electrical connections provided in said booth;

communications connections provided in said booth;

at least one electronic display in said booth, said electronic display configured to display to visitors an exhibitor presentation including at least a visual presentation particular to the respective exhibit of said booth;

an identification object provided to said visitors; and a computer network in communication with said electronic display, said computer network being configured to receive visitor information based on said identification object, said computer network configured to deliver a visitor specific exhibitor presentation in an electronic format to said electronic display based on said identification object of said visitor.

2. The apparatus of claim 1 wherein said computer network includes a program module, said visitor specific exhibitor presentation being stored on said program module, and said program module configured to deliver said visitor specific exhibitor presentation to said electronic display.

3. The apparatus of claim 2 wherein said computer network communicates with an exhibitor storage device to upload said visitor specific exhibitor presentation to said computer network.

4. The apparatus of claim 3 wherein said exhibitor storage device is a remotely-located computer, and said computer network communicates via the Internet to said remotely-located computer for uploading said visitor specific exhibitor presentation therefrom.

5. The apparatus of claim 3 wherein said computer network includes a central host computer in communication with said program module, said program module configured to store said visitor specific exhibitor presentation received from said exhibitor storage device and deliver said visitor specific exhibitor presentation to said electronic display.

6. The apparatus of claim 3 wherein said computer network includes a central host computer and a locally-resident computer, said visitor specific exhibitor presentation being uploaded from said exhibitor storage device to said central host computer, said central host computer transmitting said uploaded visitor specific exhibitor presentation to said locally-resident computer, said locally-resident computer delivering said visitor specific exhibitor presentation to said electronic display of said booth for presenting said visitor specific exhibitor presentation thereon.

7. The apparatus of claim 1 wherein said computer network is in communication with a remotely-located computer, and configured to present said visitor specific exhibitor presentation on said remotely-located computer.

8. The apparatus of claim 7 wherein said computer network is configured to host bidding for said booth, said bidding being made via said remotely-located computer.

9. The apparatus of claim 7 wherein said computer network is capable of receiving information regarding said booth to be visited by a visitor from said remotely-located computer, and said computer network is capable of providing a navigational route based on said information received.

10. The apparatus of claim 1 wherein said visitor information includes tracking information for determining foot traffic information.

11. The apparatus of claim 10 wherein said foot traffic information is incorporated into a bidding for said booth.

12. The apparatus of claim 1 wherein said identification object includes an RFID for communicating said visitor information.

13. An apparatus for hosting conventions comprising:

a convention center having a convention hall;

a plurality of booths in said convention hall for respective exhibits of respective convention center exhibitors;

at least one electronic display located in said convention hall for presenting information to visitors;

an identification object provided for at least said visitors;

an ID receiver for receiving visitor information from said identification object; and a computer network in communication with said electronic display, said computer network configured to deliver visitor specific information to be presented on said electronic display in an electronic format to said electronic display based on said visitor information;

said ID receiver being configured to communicate with said computer network, and said computer network being configured to provide notification to said booth of said visitor information.

14. The apparatus of claim 13 further comprising a plurality of electronic exhibitor displays located in said booths for presenting respective exhibitor presentations, and said computer network configured to display an appropriate exhibitor presentation to be presented to said visitor based on said visitor information.

15. The apparatus of claim 13 wherein said visitor information includes identity and location of said visitor, and said electronic display located in said convention hall being capable of presenting navigational information to said visitor based on said visitor information.

16. The apparatus of claim 13 wherein said computer network is configured to receive information regarding which exhibits are to be visited by said visitor.

17. The apparatus of claim 16 wherein said ID receiver is capable of providing said computer network with said visitor information, and said computer network is capable of providing a notification to said visitor of one or more of a navigational route, deviation from said navigational route, booths of interest to said visitor, and a level of interest of a booth to said visitor.

18. The apparatus of claim 17 wherein said notification may be presented to said visitor on said electronic display located in said convention hall.

19. A method of hosting a convention comprising:

arranging a plurality of booths in a convention center for respective exhibits of respective convention center exhibitors;

providing at least one electronic display mounted in each said booth;

presenting an exhibitor presentation including at least a visual presentation particular to said respective exhibit of each booth on said electronic display to a visitor of said convention;

providing a computer network, said computer network being in communication with said electronic display;

providing an identification object to said visitor;

receiving visitor information based on said identification object; and delivering a visitor specific exhibitor presentation in an electronic format to said electronic display via said computer network based on said visitor information.

20. The method of claim 19 wherein providing said computer network includes providing a computer network including a program module; and wherein delivering said visitor specific exhibitor presentation includes delivering said visitor specific exhibitor presentation to said electronic display from said program module; and further comprising storing said visitor specific exhibitor presentation on said program module.

21. The method of claim 19 further comprising uploading said visitor specific exhibitor presentation from an exhibitor storage device to said computer network prior to the beginning of said convention.

22. The method of claim 21 further comprising utilizing the Internet to upload said visitor specific exhibitor presentation from said exhibitor storage device, said exhibitor storage device being a remotely-located computer.

23. The method of claim 19 wherein providing said computer network includes providing a central host computer having a program module.

24. The method of claim 21 wherein uploading said visitor specific exhibitor presentation includes uploading said visitor specific exhibitor presentation from said exhibitor storage device to a central host computer, said central host computer transmitting said uploaded visitor specific exhibitor presentation to a locally-resident computer, and said locally-resident computer delivering said visitor specific exhibitor presentation to said electronic display of one or more of said booths for presenting said visitor specific exhibitor presentation on said electronic display.

25. The method of claim 19 further comprising hosting bidding for booths, said bidding being made via a remotely-located computer.

26. The method of claim 19 further comprising:

receiving information regarding said booths to be visited by said visitor from a remotely-located computer; and providing a navigational route for said convention based on said received information.

27. The method of claim 19 further comprising determining foot traffic information based on said received visitor information.

28. The method of claim 27 further comprising:

hosting bidding for said booths, said bidding being made via a remotely-located computer; and incorporating said foot traffic information into said bidding.

29. The method of claim 19 wherein presenting said visitor specific exhibitor presentation displayed in said booth includes identifying at least a class of said visitors to said booth via said identification object.

30. A method of hosting a convention comprising:

providing a convention center having a convention hall;

providing a plurality of booths in said convention hall for respective exhibits of respective convention center exhibitors;

providing an electronic display located in said convention hall for presenting information to visitors;

providing a computer network in communication with said electronic display;

delivering by said computer network said information to be presented on said electronic display in an electronic format to said electronic display;

providing an identification object for at least said visitors to the convention;

providing an ID receiver for receiving visitor information from said identification object;

communicating said visitor information to said computer network;

providing notification to said booth of said visitor information;

presenting, on said electronic display, an appropriately selected exhibitor presentation to said visitor based on said visitor information via said computer network.

31. The method of claim 30 further comprising presenting, on said electronic display, navigational information to said visitor based on said visitor information.

32. The method of claim 30 further comprising:

said visitor identifying to said computer network exhibits to be visited by said visitor;

said ID receiver providing said computer network with said visitor information; and said computer network providing notification to said visitor of one or more of a navigational route, a deviation from said navigational route, said booths of interest to said visitor, and a level of interest of said booth to said visitor, such notification being based on said exhibits to be visited and on said visitor information.

33. A system for hosting conventions comprising:

a convention hall;

a plurality of permanently arranged booths in said convention hall for respective exhibits of respective exhibitors;

at least one electronic display located in each of said booths for presenting exhibitor presentations to visitors;

an identification object provided to each of said visitors;

an ID receiver for receiving visitor information from said identification objects; and a computer network in communication with said electronic displays and said ID receiver, said computer network being configured to provide notification to said plurality of booths of said visitor information in response to said ID receiver receiving said visitor information, said computer network configured to deliver at least one visitor specific exhibitor presentation in an electronic format to at least one of said electronic displays to be presented to said visitors in response to said ID receiver receiving said visitor information.

34. A method of hosting a convention comprising:

providing a convention center having a convention hall;

providing a plurality of booths in said convention hall for respective exhibits of respective exhibitors;

providing at least one electronic display located in each of said booths for presenting exhibitor presentations to visitors;

providing an identification object to each of said visitors to the convention;

providing an ID receiver for receiving visitor information from said identification object;

providing a computer network in communication with said electronic displays and said ID receiver;

communicating said visitor information to said computer network in response to said ID receiver receiving said visitor information;

providing notification to said plurality of booths of said visitor information in response to said ID receiver receiving said visitor information;

delivering by said computer network at least one visitor specific exhibitor presentation in an electronic format to at least one of said electronic displays in response to said ID receiver receiving said visitor information; and presenting said at least one visitor specific exhibitor presentation on said at least one of said electronic displays.

* * * * *